United States Patent [19]

Schwartz

[11] 4,419,071

[45] Dec. 6, 1983

[54] PORTABLE HIGH-FLOW RATE FLARE FOR SMOKELESS BURNING OF VISCOUS LIQUID FUELS

[75] Inventor: Robert Schwartz, Tulsa, Okla.

[73] Assignee: John Zink Company, Tulsa, Okla.

[21] Appl. No.: 289,299

[22] Filed: Aug. 3, 1981

[51] Int. Cl.[3] ..... F23B 5/00

[52] U.S. Cl. ..... 431/202; 239/419.3; 431/350; 431/278

[58] Field of Search ..... 431/278, 285, 350, 354, 431/202; 239/402, 405, 406, 419.3, 549, 558, 559, 567

[56] References Cited

U.S. PATENT DOCUMENTS

| | | | |
|---|---|---|---|
| 1,451,063 | 4/1923 | Anthony | 239/405 |
| 3,565,562 | 2/1971 | Drivet | 431/202 |
| 3,797,991 | 3/1974 | Straitz | 431/202 |
| 3,797,992 | 3/1974 | Straitz | 431/202 |
| 3,861,857 | 2/1975 | Straitz | 431/202 |
| 3,864,072 | 2/1975 | Abernathy et al. | 431/285 |
| 3,876,363 | 4/1975 | La Haye et al. | 431/210 |
| 3,894,831 | 7/1975 | Glotin et al. | 431/4 |
| 3,980,416 | 9/1976 | Goncalves et al. | 431/202 |

*Primary Examiner*—Samuel Scott
*Assistant Examiner*—Noah Kamen
*Attorney, Agent, or Firm*—Head, Johnson & Stevenson

[57] ABSTRACT

A portable adjustable flow rate flare for smokeless burning of viscous liquid fuels such as crude oil, which comprises an assembly of four coaxial circular manifolds one each for pressurized fuel, water, atomizing medium, and gas, supplying a plurality of burner heads, radially spaced, symmetrically, about at least the upper portion of the circular manifolds. The planes through each of the manifolds are parallel to each other and coaxial and adapted for mounting with axis horizontal on a base structure, so that it can be moved from one location to another. Each of the burner heads comprises a central tube receiving pressurized fuel leading to an orifice of selected size and continuing downstream from the orifice with a tubular portion of selected diameter. An annular chamber about the burner tube provides pressurized atomizing medium to the inside of the burner tube through a plurality of spaced openings so as to mix at high velocity with the flow of oil from the orifice and to atomize the oil. Ignition means are provided to ignite the flame at the tip of the burner head. Water spray may be provided at each burner head.

11 Claims, 5 Drawing Figures

PORTABLE HIGH-FLOW RATE FLARE FOR SMOKELESS BURNING OF VISCOUS LIQUID FUELS

BACKGROUND OF THE INVENTION

1. Field of the Invention

The invention lies in the field of flaring of combustible fluids. More particularly, it is concerned with the smokeless burning of large quantities of liquids, such as crude or fuel oil, under conditions where oil is being produced, and there is no means for collecting and storing the oil.

Still more particularly, this invention is concerned with a portable apparatus that can be moved from one well position to another well position, to dispose of surplus oil that must be produced during the testing of a well, to determine its production capability.

2. Description of the Prior Art

While it is old in the art to provide a flare comprising one or a plurality of separate burner heads for a fixed emplacement and for the combustion of selected combustible liquid of substantially low viscosity. There is, however, no design available in the prior art, for a type of portable liquid fuel flare, that will handle fuels of different viscosity, at variable rates of flow under smokeless combustion conditions.

SUMMARY OF THE INVENTION

It is a primary object of this invention to provide a portable equipment, that can be transported readily to remote locations, where it can be used for the disposal of liquid fuels such as crude oil, or spilled oil, or other combustible liquid.

It is a still further object of this invention to provide such a flare that can be rapidly changed from one which will handle low viscosity liquid to one that will handle high viscosity liquid, at variable flow rates.

These and other objects are realized and the limitations of the prior art are overcome in this invention, by providing a unitized construction of a plurality of circular manifolds, one each for the flow of pressurized liquid fuel, pressurized water, pressurized atomizing medium, and pressurized combustible gas. These are mounted in parallel planes about a common axis and are supported rigidly on a base frame work, so that the entire unit can be picked up and transported as a unit, and quickly set into operation.

A plurality of separate burner heads are mounted, radially spaced, around a selected upper portion of the circular manifolds. The individual burner heads can lie in a transverse plane about the axis of the assembly, or they can be tilted into a conical surface concentric with the axis of the manifolds. Depending upon the particular type of application, a system of horizontal parallel manifolds can be used with the separate burner heads spaced linearly along the assembly.

One of the important features of this invention lies in its design for portability, and lightness, to permit transportation by helicopter, for example.

Adapability to flow rates varying over a wide range can be provided by means for valving off the flow of liquids and gases to one or more of the burner heads, when the flow rate is low, and utilizing more burner heads when the flow rates are high.

It is also possible to vary the capability of handling fuels of variable viscosity by a simple change in the burner head itself that can be done very quickly.

BRIEF DESCRIPTION OF THE DRAWINGS

These and other objects and advantages of this invention and a better understanding of the principles and details of the invention will be evident from the following description taken in conjunction with the appended drawings in which.

DESCRIPTION OF THE PREFERRED EMBODIMENT

Figure 1:
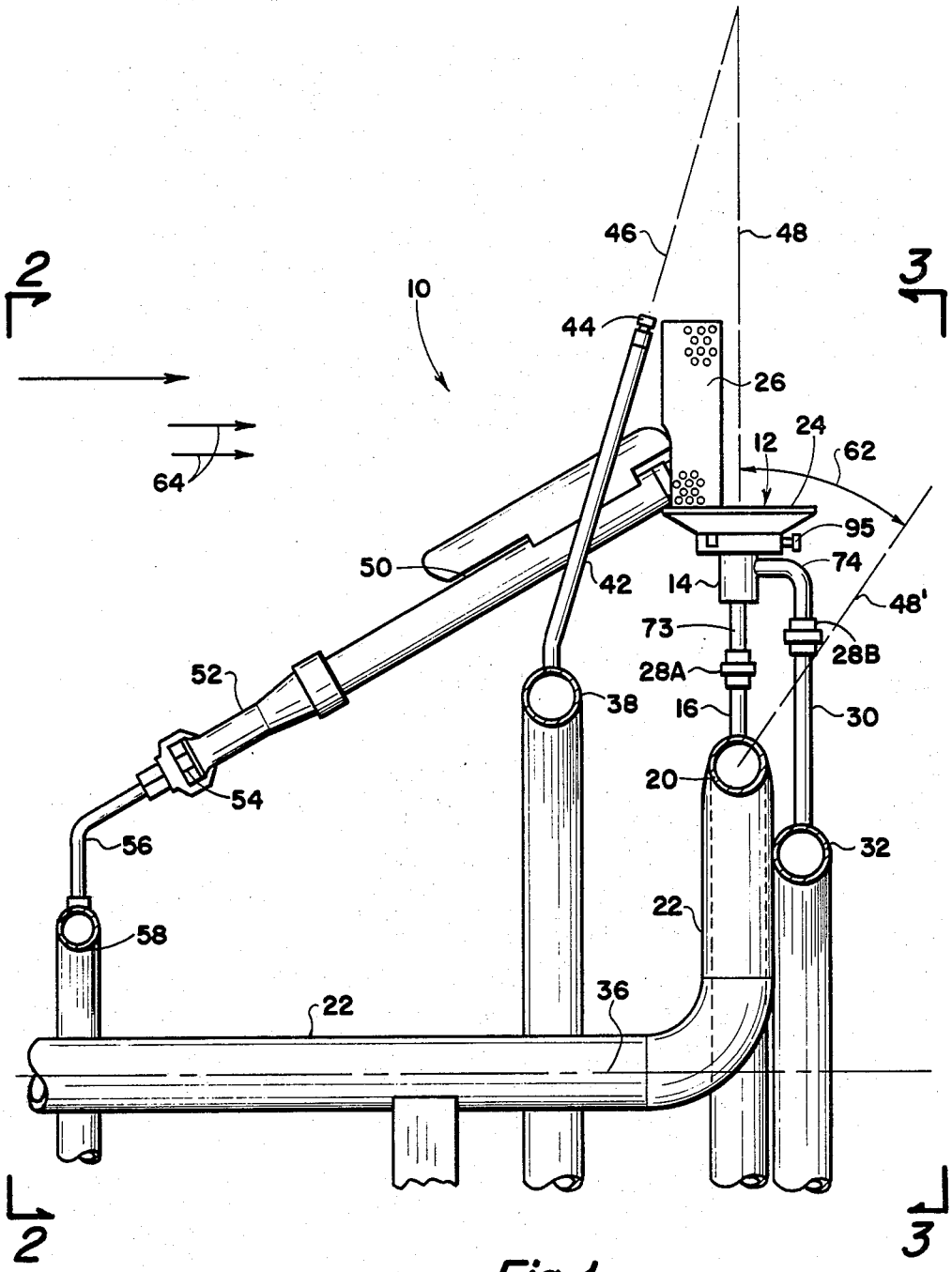
FIG. 1 illustrates a side elevational view taken through a plane parallel to a diametral plane passing through the axis of the flare assembly.
Figure 2:
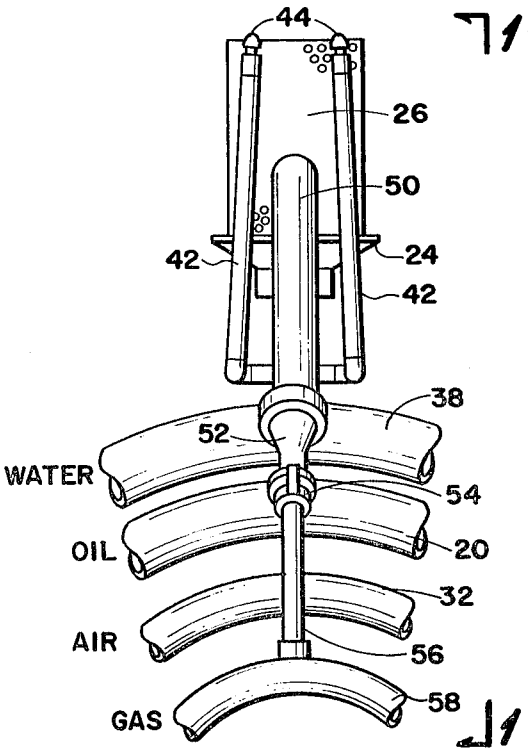
FIG. 2 is an elevational view taken along the plane 2—2 of FIG. 1.

Referring now to the drawings, there is shown in FIG. 1 a side elevational view taken along the plane 1—1 of FIG. 2.

Figure 3:
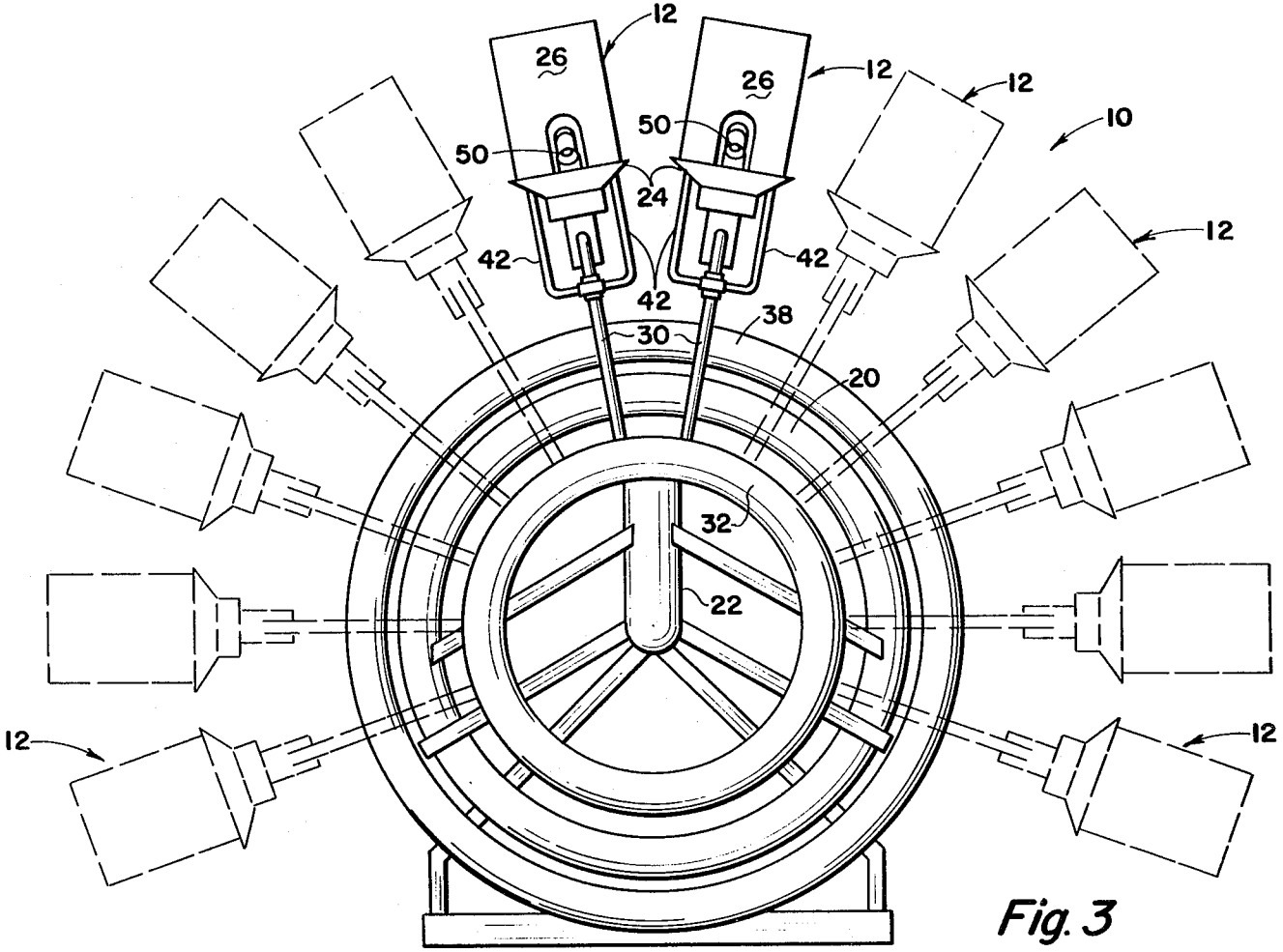
FIG. 3 is a vertical elevational view of the assembly of the flare taken from along the plane 3—3 of FIG. 1.

There are four separate manifolds, one each for pressurized water, pressurized fuel, pressurized air, fuel gas or steam, and pressurized combustible gas. A preferred design provides a series of four circular manifolds which are displaced parallel to each other, and are coaxial with each other. The manifolds and the pipes supplying the manifolds are rigidly mounted together on a base structure 66 as shown in FIG. 3. There are no special designed for convenience of support, transport and assembly.

The entire flare assembly is indicated generally by the numeral 10 and consists of a plurality of individual burner heads which are each indicated generally by the numeral 12. These are all essentially identical, and are spaced from each other either in a radial pattern, coplanar with the oil or liquid fuel manifold, or in any other suitable manner. The burner head itself is shown in FIG. 4 and will be discussed in connection with that figure, which is a preferred design.

Figure 4:
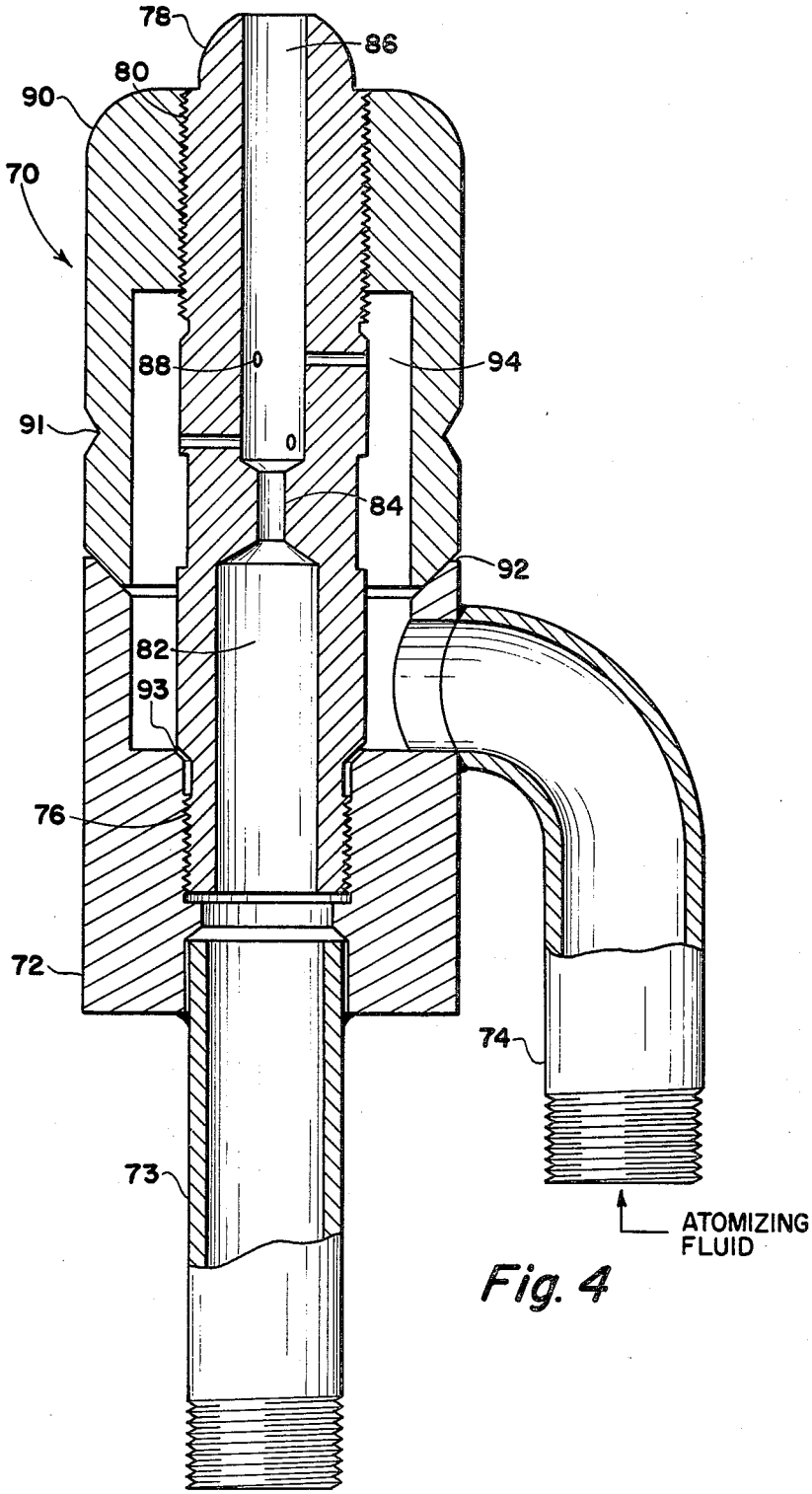
FIG. 4 is a cross-sectional view of a preferred design of the burner head of each of the burners of the flare assembly.

In FIG. 4 is illustrated a preferred version of a burner head indicated generally by the numeral 70. This includes a central burner pipe 78 which is threaded into a threaded opening 76 in a cylindrical base block 72, in which a first pipe 73 is welded coaxial with the burner tube, for the supply of fuel. A second pipe 74 is welded into the side of the block 72 for the supply of pressurized air, fuel gas or steam, as will be further described.

While this flare system can be used with many types of liquid fuels the greatest need for this type of apparatus is in the combustion of heavy oils. Where there are oil spills on the seas from a wrecked tanker, or from any other source, such as off-shore wells, the crude oil can be collected and burned at the spot to prevent its spreading shoreward, and causing great damage to the sea life and to the beaches.

Another important use is in the testing of wildcat or production wells, to determine their production capability, in flow rate of oil. To obtain this production information the well must be flowed for substantial periods of time, at variable rates of flow. In remote locations before pipelines are available, or before it is decided to provide tankage for collection of the oil produced, there must be some way of disposing of this oil, in a smokeless combustion, or other manner, to avoid pollution of the earth or the sea. Thus the use of this apparatus requires that it be highly portable, and transportable, for example, by helicopter, and that it be self-contained and easily set up, so as to provide a ready means for the disposal of excess fuel. In view of the greater use of this device for the combustion of petroleum hydrocarbons or crude oil, particularly heavy viscous crude oil, I will utilize the term heavy oil or oil as a fuel even though it will be remembered that many other types of liquid fuels can be handled, and the term "heavy" will indicate high viscosity.

The burner tube 78 comprises a cylindrical tubular portion threaded at one end 76 to be received into the base block 72, and to seal the threads at the shoulder 93. The burner tube comprises an inlet end 82 of selected diameter for the oil flow from the pipe 73 and a nozzle portion 84 of selected length and diameter not only to meter the oil, but to partially atomize the oil. The burner tube opens to a larger diameter 86 downstream of the orifice 84. There are a plurality of openings 88 through the wall of the tubular portion 86 of selected size and number. These can be arranged in one transverse plane or in two or more transverse planes.

After the burner tube is screwed into the base unit 72 and provides a tight seal at 93, a cover 90 is screwed onto the exposed end of the burner tube at thread 80. The cover 90 makes up against the shoulder 92 to provide a seal for an annular space 94 around the burner tube and inside of the cover so that high pressure air, fuel gas or steam flowing in through the pipe 74 can flow into the annular space 94. The air, fuel gas or steam flow inwardly to the space 86 to further atomize the oil, and create extremely fine particles which are thoroughly mixed with the atmoizing medium. As the mixture issues out of the terminal end of the burner, it can be ignited, to provide a very hot flame.

As shown in FIG. 1 the burner head 70 of FIG. 4 can be supported on the pipe 73 by being threaded into a pipe 16 mounted either by threading or welding at 18 to a manifold 20. The manifold is supplied by oil through the pipe 22 as indicated.

It may be desirable to mount the burner head, by means of a coupling 28A, for example, so that it can be replaced quickly as needed. Also, by inserting diaphragms into the couplings the flow of fuel oil to the couplings 28A, and atomizing medium to the coupling 28B can be cut off as desired, from one or more of the multiple heads as shown in FIG. 3. The pipes 30 which are attached in circumferential spacing about the atomizing medium fold 32 support a second coupling 28B which carries atomizing medium into the burner head through pipe 74.

As shown in FIG. 3, there can be a selected number of circumferentially spaced burner heads 12 mounted symmetrically on the group of circular manifolds. If the assembly is mounted on a tower or other means above the land surface, or above the sea surface, for example, on an off-shore platform, the number of heads can cover a circumferential area of 180°, or possibly more. However, if the number of heads is to be reduced, they can be effectively positioned near the upper portion of the manifold. That is, the heads that will be cut off from use, for less than maximum flow rate of fuel, should be on the lower positions on each side of the manifold.

An important part of the burner head is a perforated metal screen 26 which is mounted on the periphery of 24, and extends through some desired angle to protect the flame in the burner from direct contact with the wind. The wind will be flowing from the left in FIG. 1 as shown by the arrows 64. While the preferred wind direction is parallel to the axis 36 of the assembly, the operation of the device for wind at substantial angles to the axis provides substantially comparable operation of the flare. It would not, however, be desirable to position the assembly so that the wind is parallel to the plane of the array of burners, because it is important that the wind be able to reach each of the burner heads and provide air to the flame.

Because separate burner heads are used and particularly because of the possible use of very viscous oil, it is important to have an ignition device such as the pilot burner 50 indicated in FIG. 1. This is of conventional design, and provides an orifice 54 in the gas line 56 connected to the manifold 58. The jet of pressurized gas at 54 induces a flow of air to mix with it and to provide a combustible mixture at the tip of the pilot. Conventional means can be provided for igniting the pilot at any time the flare is to be started.

While I show a separate pilot igniter for each of the burner heads it is not necessary that a separate pilot be used for each burner head. However, at times when the oil is very viscous, and difficult to atomize, it is desirable to have a very strong pilot flame to ensure ignition and reignition, continuously of the flow of oil droplets and atomizing medium issuing from the burner tube.

There is one further important part of this system and that is the supplying of pressurized water from the manifold 38 through one or more pipes 42 to spraly nozzles 44. These take pressurized water to create a fine spray, which issues from the spray nozzles 44 along an axis 46 which is designed to intersect the axis 48 of the flame issuing from the burner tube at some selected point above the end of the burner tube.

Because of the possible use of viscous oil, the flame is protected from anything such as wind or a spray of water until it is well established, and that means until it has progressed outwardly a sufficient distance, and the flame is hot enough for droplets to vaporize. Then the combination of the water spray and the oil can chemically react to provide the formation of carbon monoxide and hydrogen, which provide smokeless combustion.

Referring now to FIG. 2 there is shown a view of one burner head taken along the plane 2—2 of FIG. 1. In this view the pilot 50 is clearly seen and its attachment to the circular manifold 58, supplying the pressurized gaseous fuel to maintain the pilot flame. Also shown in the burner head from the windward side of the screen 26, and the opening through which the pilot burner 50 is inserted. Also shown on the windward side of the burner are the water pipes 42 which supply the pressurized water to the spray nozzles 44 for intersection into the flame issuing above the burner. Clearly shown also are the water manifold 38, the oil manifold 20, the gas manifold 58 and the atomizing medium manifold 32.

In FIG. 3 the view is taken along the plane 3—3 of FIG. 1, and shows the lee-side of the burner assembly. In other words, the wind approaches the burner assembly from the opposite side of the sheet and the flame is protected from this wind by the shields 26. While only two of the burner heads are shown in detail the others are indicated by dashed lines so that possibly 12 or more heads can be used on one assembly as desired.

If the flow rate of fuel is low, and it is desired to load the burner heads at their maximum capacity, then a plurality of head on the sides of the assembly would be closed off by cutting the flow of fuel, atomizing medium, water, and gas to the burner heads. This can be done very quickly, as desired, either by valves in each of the lines or by couplings into which seal discs can be inserted. In FIG. 3 the base frame work 66 is clearly shown, and some of the supporting braces 40.

The burner heads are shown in a transverse plane to the axis of the assembly, which would be the preferred construction. This permits the wind to be at right angles to the axis of the burner. However, it is possible to tilt the heads with respect to the manifolds along a conical surface at some selected angle to the axis of the assembly, without deterioration of the capability for smokeless combustion of high flow rates of oil. This conical position is indicated by the dashed line 48' of FIG. 1.

Figure 5:
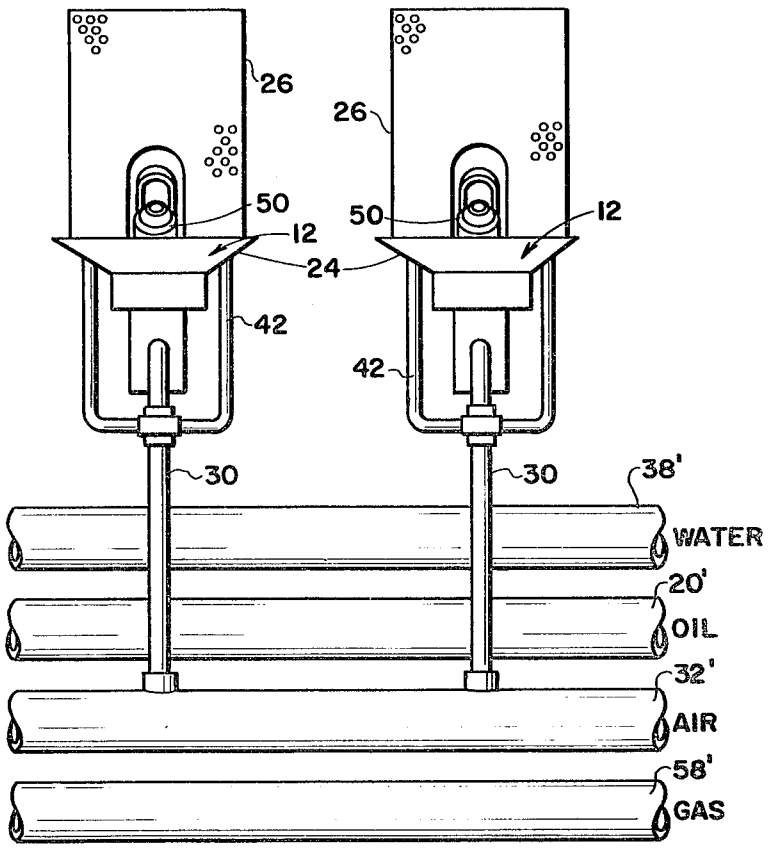
FIG. 5 illustrates an alternative construction from FIG. 3 wherein the individual manifolds are colinear and the burner heads are all in a plane parallel to the plane of the manifolds.

Referring briefly to FIG. 5 there is an alternative construction of the manifold 38', 22', 34' and 58', which are shown as linear and parallel spaced pipes which support the burner heads 12, which are mounted coplanar with the manifolds. The plane of this structure is shown as vertical although it will be clear that it is possible also to tilt the assembly so that its plane is at some selected angle from the vertical up to a possible angle of 30° to 45°. As previously mentioned the preferred angle of the wind to the assembly of FIG. 5 would be perpendicular to the plane of the drawing although the wind can approach from any desired angle up to 30° to 45°, for example, from the perpendicular to the plane of the burners either in a lateral or a vertical direction.

One of the features of the burner assembly shown in FIG. 4 is that by simply unscrewing the cap 90 and exposing the burner tube 78, it can be unscrewed from the base mounting 72, which is supported by the pipe 73, and a new burner tube 78 installed into the base by threading it into the corresponding thread 76. Thus the size of the orifices 84 and/or 88 can be varied quickly, by replacing the burner tube with another one of a different selected sizes or quantity of orifices. Thus, as the location is changed and fuel properties are changed, the burners can be modified quickly to accomodate any desired range of viscosity of the fuel.

I have discussed this invention in relation to viscous crudes or heavy fuel oils; since that problem is a more difficult one, than, for example, the smokeless combustion of lighter, low viscosity fuel or crude, particularly those that contain many lighter hydrocarbon components, that can be more easily atomized, and evaporated more readily in the flame. Adaptability to combustion of liquids of high or low viscosity, or those with more or less light components, is in the design of the central burner tube.

I show the wind shields 26 as separate units on each head. This is convenient when a separate pilot burner is used with each head, such as with heavy fuel oil. On the other hand, when the fuel is more easily atomized, and particularly when it contains lighter components, it may not be necessary to have separate pilot burners for each head. In that case one pilot head may be used simultaneously to ignite two or more adjacent burner heads. In that case, it is preferable to have a single strip of perforated metal to protect from the wind, all the heads in each group.

While I clearly show the preferred method of injecting water into the flame, it is possible also to inject water into the oil line 73 upstream of the nozzle 84, in addition to or in place of the water injection into the flame.

While the invention has been described with a certain degree of particularity, it is manifest that many changes may be made in the details of construction and the arrangement of components. It is understood that the invention is not to be limited to the specific embodiments set forth herein by way of exemplifying the invention, but the invention is to be limited only by the scope of the attached claim or claims, including the full range of equivalency to which each element or step thereof is entitled.

What is claimed is:

1. A portable, multi-burner flare for burning of combustible liquid fuel of widely different viscosity, comprising:

a framework for supporting in a vertical array;

(a) a liquid fuel manifold in the form of at least a portion of a circle, a plurality of first pipes extending along an outward axis from said manifold at spaced locations;

(b) a plurality of burner heads mounted on the ends of said first pipes; each of said burner heads having an orifice and means to atomize and direct said liquid fuel through said burner heads from said manifold along said outward axis;

(c) a water manifold parallel and coaxial with said liquid fuel manifold, a plurality of second pipes extending outward of said water manifold, a water spray nozzle connected to each of said second pipes and positioned so that its axis is directed toward said outward axis at a selected distance downstream from said burner head;

(d) a gas manifold parallel to and coaxial with said liquid fuel and said water manifolds, a plurality of third pipes spaced along said gas manifold, and means to connect to pilot burners each of said third pipes which are positioned in the vicinity of said burner heads; and (e) means to supply pressurized liquid fuel, water and gas, to said respective manifolds.

2. The flare as in claim 1 in which the number of oil burner heads, atomizing medium outlet pipes, and water sprayers are all the same.

3. The flare as in claim 1 in which the number of pilot burner is dependent on the viscosity, flamability and temperature of the oil and is equal to or less than the number of burners heads.

4. The flare as in claim 1 in which the preferred position of said flare while operating is with the common axis of said manifolds collinear with the wind, whereby the wind will be blowing substantially perpendicular to the individual axes of the flames from each of the burners.

5. The flare as in claims 1, 2, 3 or 4 in which the flames are radially projected with at least 5 degrees separation between adjacent flames for avoidance of interlaced or interfering flames.

6. The flare of claim 1 including a perforated metal wall along one side of said burner head.

7. The flare of claim 4 including a perforated wall partially encircling said outward axis above said burner head and located on the leeward side thereof relative to said wind.

8. A portable, multi-burner flare for burning of combustible liquid fuel of widely different viscosity, comprising:

a framework for supporting in a vertical array;

a liquid fuel manifold, a plurality of first pipes extending along an outward axis from said manifold at spaced locations;

(b) a plurality of burner heads mounted on the ends of said first pipes; each of said burner heads having an orifice and means to atomize and direct said liquid fuel through said burner heads from said manifold along said outward axis;

(c) a water manifold parallel with said liquid fuel manifold, a plurality of second pipes extending outward of said water manifold, a water spray nozzle connected to each of said second pipes and positioned so that its axis is directed toward said outward axis at a selected distance downstream from said burner head;

(d) a gas manifold parallel wtith said liquid fuel and said water manifolds, a plurality of third pipes spaced along said gas manifold, and means to connect pilot burners to each of said third pipes which are positioned in the vicinity of said burner heads; and (e) means to supply pressurized liquid fuel, water and gas, to said respective manifolds.

9. The flare as in claim 8 in which the preferred position of said flare while operating is with the common axis of said manifolds perpendicular to the wind, whereby the wind will be blowing substantially perpendicular to the individual axes of the flames from each of the burners.

10. A portable, multi-burner flare for burning of combustible a mixture of liquid fuel of widely different viscosity and water, comprising:

a framework for supporting in a vertical array;

(a) a liquid fuel manifold, a plurality of first pipes extending along an outward axis from said manifold at spaced locations;

(b) a plurality of burner heads mounted on the ends of said first pipes; each of said burner heads having an orifice and means to atomize and direct said liquid fuel and water mixture through said burner heads from said manifold along said outward axis;

(c) a gas manifold parallel with said liquid fuel and said water manifolds, a plurality of third pipes spaced along said gas manifold, and means to connect pilot burners to each of said third pipes which are positioned in the vicinity of said burner heads; and (d) means to supply pressurized liquid fuel and water mixture, and gas to said respective manifolds.

11. The flare as in claim 10 in which the preferred position of said flare while operating is with the common axis of said manifolds perpendicular to the wind, whereby the wind will be blowing substantially perpendicular to the individual axis of the flames from each of the burners.

* * * * *